US006422894B1

(12) United States Patent
Endo et al.

(10) Patent No.: US 6,422,894 B1
(45) Date of Patent: Jul. 23, 2002

(54) CONNECTOR FITTING DETECTION CONSTRUCTION

(75) Inventors: Takayoshi Endo; Akira Maeda; Satoru Kaneko, all of Shizuoka (JP)

(73) Assignee: Yazzki Corporation, Tokyo (JP)

( * ) Notice: Subject to any disclaimer, the term of this patent is extended or adjusted under 35 U.S.C. 154(b) by 668 days.

(21) Appl. No.: 08/832,672

(22) Filed: Apr. 4, 1997

(30) Foreign Application Priority Data

Apr. 8, 1996 (JP) ..... 8-085596

(51) Int. Cl.[7] ..... H01R 3/00
(52) U.S. Cl. ..... 439/489; 439/188
(58) Field of Search ..... 439/488, 489, 439/188, 350

(56) References Cited

U.S. PATENT DOCUMENTS 5,464,353 A * 11/1995 Saijo et al. ..... 439/489
5,588,872 A * 12/1996 Fukuda ..... 439/489
5,651,693 A * 7/1997 Fukuda et al. ..... 439/489

FOREIGN PATENT DOCUMENTS

JP 4-35372 3/1992
JP 6-310209 11/1994 ..... H01R/13/639

* cited by examiner

*Primary Examiner*—Hien Vu
(74) *Attorney, Agent, or Firm*—Sughrue Mion, PLLC

(57) ABSTRACT

A connector fitting detection construction in which even if dirt, dust or the like is deposited on contacts, the contacts can be positively electrically connected together, thereby enhancing the reliability of a fitting detection function. In the connector fitting detection construction for detecting a fitted condition of a pair of connectors, a cantilever-like lock arm is provided on one connector housing, and the lock arm can be elastically flexed so that its free end can be moved in a direction generally perpendicular to a connector fitting direction. A short-circuiting electrode of a U-shape, having contact portions provided respectively on outer sides of pair of legs, is mounted on the lock arm, with the pair of legs disposed respectively on opposite sides of the lock arm. A pair of detection electrodes are provided in a projected manner within the other connector housing, and when the lock arm is retainingly engaged with the other connector housing, the pair of detection electrodes respectively contact the contact portions of the short-circuiting electrode mounted on the lock arm.

7 Claims, 8 Drawing Sheets

CONNECTOR FITTING DETECTION CONSTRUCTION

BACKGROUND OF THE INVENTION

1. Field of the Invention

This invention relates to a connector fitting detection construction for detecting a fitted condition of a pair of connectors.

2. Background

Recently, various safety devices are mounted on an automobile, and a connector for electrically connecting these devices is required to have a high reliability. To meet this requirement, there has been proposed a connector for connecting a wire harness in an automobile, which connector has a fitting detection construction.

A connector with such a fitting detection construction, disclosed for example in Unexamined Japanese Patent Publication No. Hei. 6-310209, will now be described with reference to FIGS. 14 to 16. FIG. 14 is a perspective view showing male and female connectors having the conventional fitting detection construction, FIG. 15 is a perspective view showing a short-circuiting electrode and locking detection electrodes, and FIG. 16 is a cross-sectional view showing the male and female connectors in the process of fitting the two connectors together. A recess 3 is formed in an upper surface of a male connector housing 1, and extends in a forward-rearward direction. A cantilever-like, elastic lock 5, having a free end defined by its rear end, is provided in the recess 3. An engagement hole 7 is formed through the elastic lock 5 in an upward-downward direction. The short-circuiting electrode 9 shown in FIG. 15 is mounted on the elastic lock 5.

A female connector housing 11 is formed into a hood-like shape so as to receive the male connector housing 1 therein. Positioning ribs 13*a* and 13*b* are formed on an upper inner surface of the female connector housing 11, and are engageable respectively with opposite side surfaces of the recess 3 so as to position the male connector housing. The pair of locking detection electrodes 15*a* and 15*b*, shown in FIG. 15, are provided on the upper inner surface of the female connector housing 11, and are disposed between the positioning ribs 13*a* and 13*b*. The locking detection electrodes 15*a* and 15*b* are arranged in such a manner that an engagement rib 17, formed on the upper inner surface of the female connector housing 11, is interposed between the two electrodes 15*a* and 15*b*. The engagement rib 17 is engageable in the engagement hole 7.

In the pair of connectors of the above construction, the male connector housing 1 is opposed to the front side of the female connector housing 11, and then the male connector housing 1 is inserted into the female connector housing 11 in such a manner that the positioning ribs 13*a* and 13*b* are received in the recess 3 in the male connector housing 1. At this time, the engagement rib 17 engages the upper surface of the elastic lock 5 to flex the same downwardly. Therefore, the short-circuiting electrode 9 is also displaced downward, and will not contact the locking detection electrodes 15*a* and 15*b*.

When the male connector housing 1 is inserted into a proper position, the engagement rib 17 becomes received in the engagement hole 7, so that the elastic lock 5 is restored upwardly because of its elasticity. As a result of the engagement of the engagement rib 17 into the engagement hole 7, the two housings 1 and 11 are engaged with each other. The short-circuiting electrode 9 embraces the elastic lock 5 at one end portion thereof in such a manner that this one end portion is bent to lie on the upper surface of the elastic lock 5, and the locking detection electrodes 15*a* and 15 are disposed respectively on the opposite sides of the engagement rib 17. Therefore, when the elastic lock 5 is restored upwardly, the short-circuiting electrode 9 short-circuits the two locking detection electrodes 15*a* and 15*b* together.

Namely, the locking detection electrodes 15*a* and 15*b* are short-circuited together simultaneously when the male connector housing 1 and the female connector housing 11 are engaged with each other, so that the completely-fitted condition of the pair of connectors can be detected.

In the above connector fitting detection construction, however, the short-circuiting electrode 9, mounted on the elastic lock 5, contacts the locking detection electrodes 15*a* and 15*b*, mounted on the upper inner surface of the female connector housing 11, when the elastic lock 5 is restored upwardly. Therefore, the short-circuiting electrode 9 is brought into contact with the locking detection electrodes 15*a* and 15*b* in a direction generally perpendicular to their contact surfaces, and even if dirt or dust is deposited on their contacts, no movement (sliding contact movement between the contact surfaces) is effected for removing such foreign matter, and therefore at the time of detecting the contact condition, the incomplete contact has often been encountered because of the foreign matter interposed between the contact surfaces. As a result, the fitting could not be detected although the connectors were properly fitted together, and the reliability of the fitting detection function was lowered.

SUMMARY OF THE INVENTION

The present invention has been made in view of the above problems, and an object of the invention is to provide a connector fitting detection construction in which even if dirt, dust or the like is deposited on contacts, the contacts can be positively electrically connected together, thereby enhancing the reliability of a fitting detection function.

The above object of the invention has been achieved by a connector fitting detection construction for detecting a fitted condition of a pair of connectors, including a lock arm, which can be elastically flexed in a direction generally perpendicular to a connector-fitting direction, is provided on a connector housing of one of the two connectors; a short-circuiting electrode is mounted on the lock arm, and includes a pair of legs each having a contact portion on an outer side thereof, the contact portions being arranged in a direction perpendicular to a direction of flexing of the lock arm; and a pair of detection electrodes are provided in a projected manner within a connector housing of the other connector, and when the lock arm is retainingly engaged with the connector housing of the other connector, the pair of detection electrodes respectively contact the contact portions of the short-circuiting electrode mounted on the lock arm.

The connector fitting detection construction can be arranged such that a pair of parallel limitation walls for receiving the lock arm therebetween is provided on the connector housing of the other connector, and each of the detection electrodes is embedded in the associated limitation wall in such a manner that a contact surface of the detection electrode is exposed, and is disposed flush with an inner surface of the limitation wall.

The connector fitting detection construction can be arranged such that the short-circuiting electrode is formed into a generally U-shape, and the pair of legs are disposed respectively on opposite sides of the lock arm.

The connector fitting detection construction can be arranged such that a slanting surface for guiding the introduction of the contact portion of the short-circuiting electrode is formed at an end of a contact surface of each of the pair of detection electrodes for receiving the contact portions.

The connector fitting detection construction can be arranged such that a tapering projection for guiding the introduction of the contact portion of the short-circuiting electrode is formed on each of the contact portions to be introduced into a space between the pair of detection electrodes.

In the above connector fitting construction, by the flexing of the lock arm, the contact portions of the short-circuiting electrode move upward and downward in sliding contact with the respective contact surfaces of the detection electrodes.

In the connector fitting detection construction in which the limitation walls are provided, the contact surfaces of the detection electrodes are exposed, and disposed flush respectively with the opposed surfaces of the limitation walls, and the short-circuiting electrode is kept inwardly of the detection electrodes by the limitation walls, and the contact portions slide respectively over the opposed surfaces of the limitation walls, and are guided respectively to the contact surfaces of the detection electrodes.

In the connector fitting detection construction in which the short-circuiting electrode is formed into a generally U-shape, the short-circuiting electrode is fitted on the lock arm, with their legs disposed respectively on the opposite sides of the lock arm.

In the connector fitting detection construction in which the slanting surface is formed on the end of the contact surface of each detection electrode, the contact portions can be smoothly guided into the space between the detection electrodes by the slanting surfaces.

In the connector fitting detection construction in which the tapering projection is formed on each contact portion of the short-circuiting electrode, the contact portions of the short-circuiting electrode can be smoothly guided into the space between the detection electrodes by these projections.

DETAILED DESCRIPTION OF THE PREFERRED EMBODIMENTS

The preferred embodiments for a connector fitting detection construction of the present invention will now be described in detail with reference to the drawings.

First Embodiment

Figure 1:
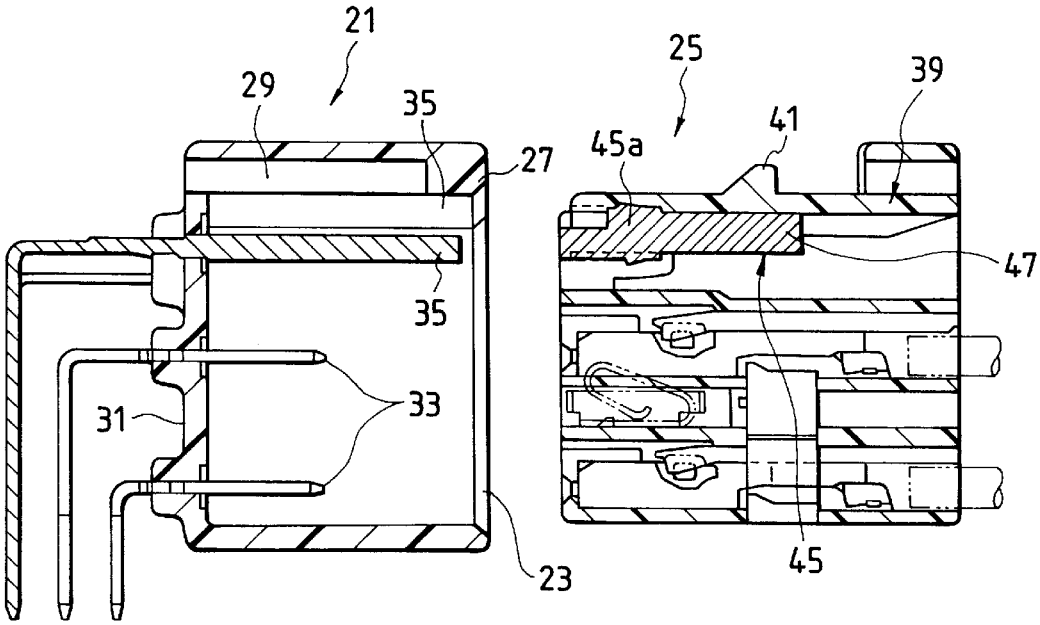
FIG. 1 is a cross-sectional view showing a pair of male and female connectors having a fitting detection construction of a first embodiment of the invention.

As shown in FIG. 1, a female housing 21 is formed into a hood-like shape, and has a fitting opening 23 at its front side, and the male housing 25 can be inserted into the female housing 21 through the fitting opening 23.

A press-down portion 27 depends from an upper inner surface of the female housing 21 at a front portion thereof, and a retaining recess 29 is formed in this upper inner surface, and extends rearwardly from the press-down portion 27. A plurality of male terminals 33 extend through a rear wall 31 of the female housing 21 into the interior thereof. A pair of parallel detection electrodes 35 extend through an upper portion of the rear wall 31. The pair of detection electrodes 35 and the male terminals 33 are connected to a conduction detection circuit on a board (not shown) on which the female housing 21 is mounted.

Figure 2:
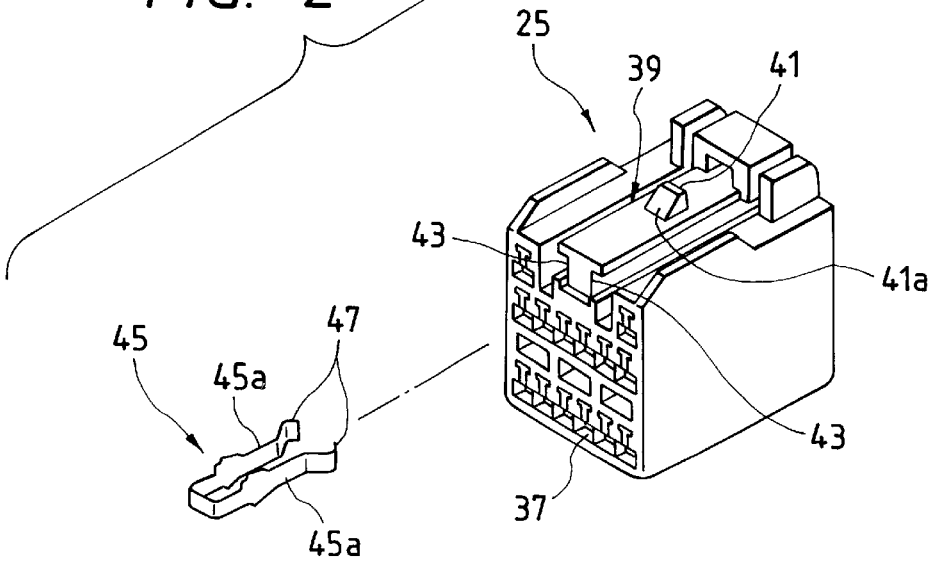
FIG. 2 is a perspective view of a male housing shown in FIG. 1.

As shown in FIG. 2, a plurality of male terminal insertion openings 37 are formed in a front end surface of the male housing 25. A lock arm 39 is formed on an upper surface of the male housing 25, and extends in a forward-rearward direction with respect to the male housing 25. The lock arm 39 is connected at its front end to the male housing 25, and has a rear free end. Therefore, the lock arm 39 is in the form of a cantilever, and can be elastically flexed upward and downward (that is, in a direction generally perpendicular to a connector fitting direction) about the front end so that the free end can be moved upward and downward.

A lock projection 41 is formed on an upper surface of the lock arm 39 at a generally central portion thereof in the forward-rearward direction, and the lock projection 41 has a slanting front surface 41*a*. When fitting the connectors together, the slanting surface 41*a* of the lock projection 41 abuts against the press-down portion 27 of the female housing 21.

Reception grooves 43 are formed respectively in opposite side surfaces of the lock arm 39, and each reception groove 43 has a channel-shaped cross-section, and is open to the front end surface of the lock arm 39. The short-circuiting electrode 45, formed of an electrically-conductive metal sheet, is mounted on the lock arm 39. The short-circuiting electrode 45 is formed into a generally U-shape, and has a pair of legs 45*a* and 45*a*, and a distal end portion of each of the legs 45*a* and 45*a* is bent outwardly into a generally V-shape to provide a contact portion 47. The short-circuiting electrode 45 is mounted on the lock arm 39, with the pair of legs 45*a* and 45*a* received respectively in the reception grooves 43.

Figure 3:
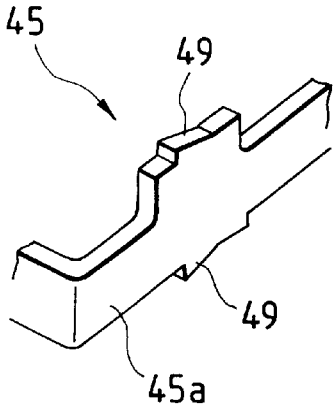
FIG. 3 is an enlarged view of an important portion of a short-circuiting electrode shown in FIG. 2.

Therefore, the short-circuiting electrode 45, mounted on the lock arm 39, has the contact portions 47 projected respectively from the opposite sides of the lock arm 39. The short-circuiting electrode 45 has resiliency, and the projected contact portions 47 can be resiliently displaced toward and away from the opposite sides of the lock arm 39, respectively. When fitting the connectors together, the short-circuiting electrode 45, mounted on the lock arm 39, is inserted into a space between the detection electrodes 35. The distance between the apexes of the contact portions 47 is slightly larger than the distance between the opposed detection electrodes 35. As shown in FIG. 3, a retaining projection 49 is formed on each of the pair of legs 45*a* and 45*a* of the short-circuiting electrode 45, and these retaining projections 49 are retainingly engaged respectively in retaining portions (not shown, but see FIG. 1) formed respectively in the reception grooves 43, thereby preventing the short-circuiting electrode 45 from disengagement from the lock arm 39.

Figure 4:
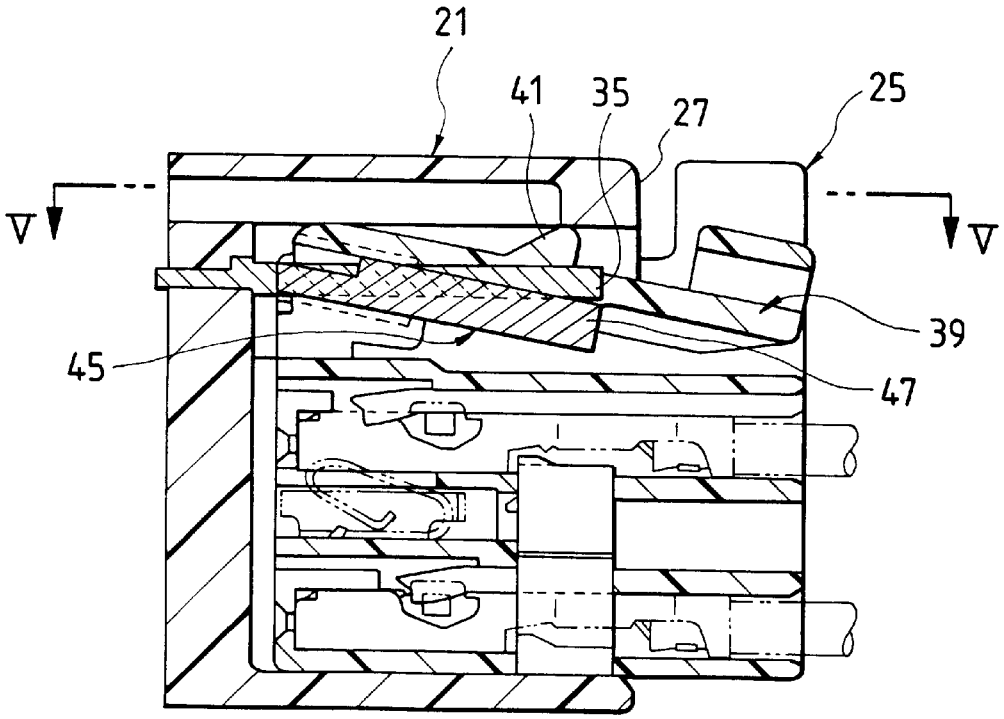
FIG. 4 is a cross-sectional view showing the fitting detection construction in a half-fitted condition.
Figure 5:
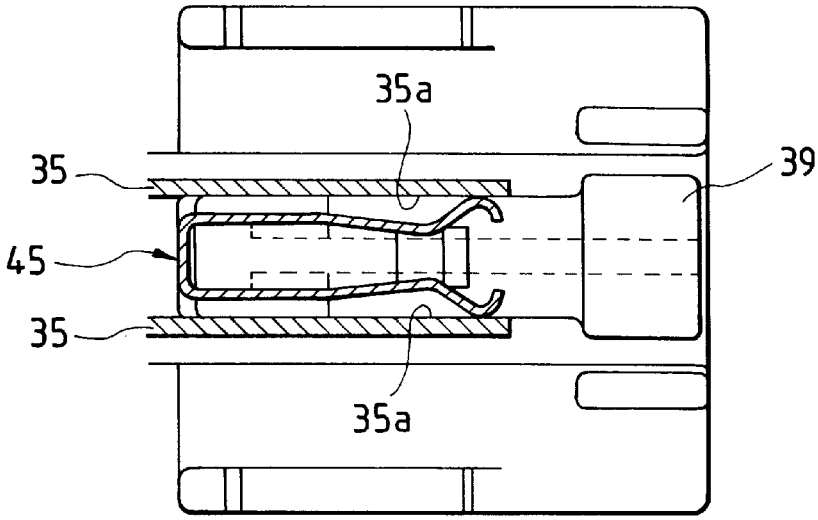
FIG 5 is a view as seen along the line V—V of FIG. 4.

The operation of the above fitting detection construction will now be described with reference to FIGS. 4 to 6. The front side of the male housing 25 is registered with the fitting opening 23 in the female housing 21, and the male housing 25 is inserted into the female housing 21, and as a result the lock projection 41 of the lock arm 39 abuts against the press-down portion 27 of the female housing 21, so that the free end of the lock arm 39 is moved downward, as shown in FIG. 4.

At this time, the short-circuiting electrode 45, mounted on the lock arm 39, is moved downward. In this condition, the short-circuiting electrode 45 is disposed between the detection electrodes 35 as shown in FIG. 5, but since the contact portions 47 are disposed below the detection electrodes 35 as shown in FIG. 4, the short-circuiting electrode 45 is out of contact with the detection electrodes 35.

Figure 6:
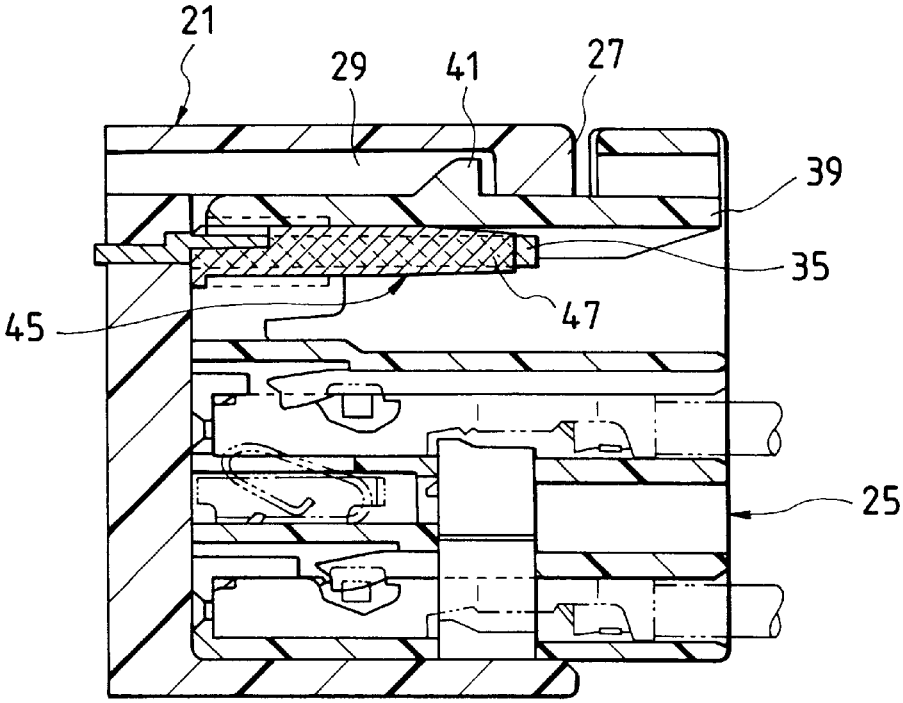
FIG. 6 is a cross-sectional view showing the fitting detection construction in a completely-fitted condition.

When the male housing 25 is further inserted, the lock projection 41 of the lock arm 39 is disengaged from the press-down portion 27, and becomes received in the retaining recess 29, so that the lock arm 39 moves upward because of its elastic restoring force, as shown in FIG. 6. Therefore, the short-circuiting electrode 45, mounted on the lock arm 39, also moves upward in such a manner that the contact portions 47 upwardly slide respectively over contact surfaces 35*a* (see FIG. 5) of the detection electrodes 35 because of the resiliency of the short-circuiting electrode 45. Therefore, dirt, dust and the like, deposited on the detection electrodes 35 and the contact portions 47, are removed by the sliding movement, and the short-circuiting electrode 45 contacts each detection electrode 35, with no foreign matter interposed therebetween.

As a result of contact of the short-circuiting electrode 45 with the pair of detection electrodes 35, these detection electrodes 35 are electrically connected, and the completely-fitted condition, in which the lock arm 39 is retained, is detected.

In the first embodiment, the short-circuiting electrode 45 has the resiliency, and the contact portions 47 are pressed respectively against the detection electrodes 35 because of this resiliency. However, the short-circuiting electrode 45 may not have resiliency, in which case the width of the short-circuiting electrode 45 is so determined that the opposite side surfaces of the short-circuiting electrode 45 can contact the contact surfaces 35*a* of the pair of detection electrodes 35, respectively.

In the fitting detection construction of the first embodiment, the pair of detection electrode 35 project into the interior of the female housing 21, and the short-circuiting electrode 45 to be disposed between the detection electrodes 35 is mounted on the lock arm 39 of the male housing 25. With this arrangement, the contact portions 47 of the short-circuiting electrode 45 can be moved upward and downward through the flexing of the lock arm 39, and thus the contact portions 47 can be moved in sliding contact with the contact surfaces 35*a* of the detection electrodes 35, respectively. As a result, dirt, dust and the like, deposited on the detection electrodes 35 and the short-circuiting electrode 45, can be removed, and the incomplete contact in the fitting detection is prevented, and therefore the reliability of the fitting detection function is enhanced.

Second Embodiment

Figure 7:
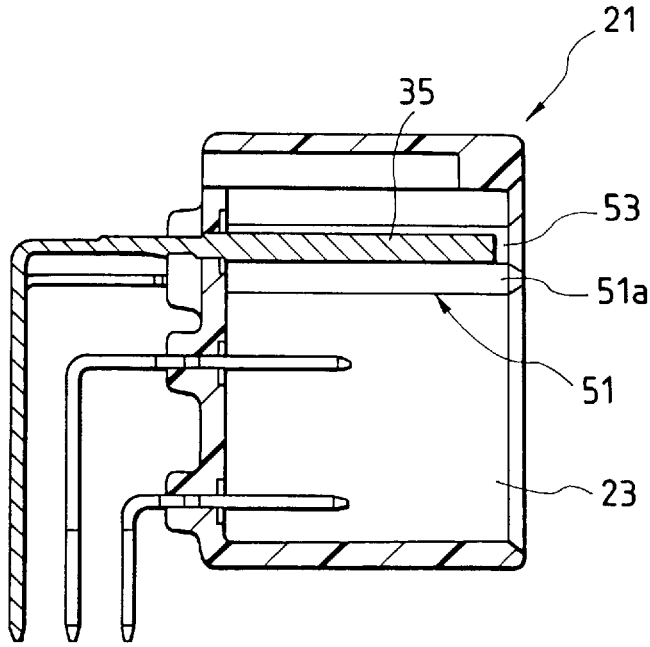
FIG. 7 is a cross-sectional view showing a female housing used in a second embodiment of fitting detection construction.

Next, a second-embodiment of a fitting detection construction of the invention will be described with reference to FIGS. 7 to 9. A male housing used in this embodiment is the same as that of the first embodiment, and therefore explanation thereof will be omitted here. In this embodiment, the pair of limitation walls 51 are provided within the female housing 21. Embedding grooves 53 are formed respectively in opposed surfaces of the limitation walls 51, and extend in a forward-rearward direction with respect to the female housing 21. The pair of detection electrodes 35 are embedded in the embedding grooves 53, respectively.

Figure 8A:
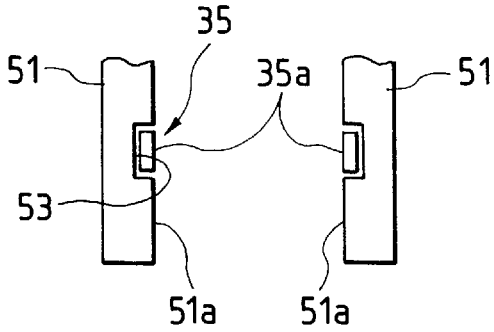
FIGS. 8A and 8B are front-elevational views showing detection electrodes embedded respectively in limitation walls.
Figure 8B:
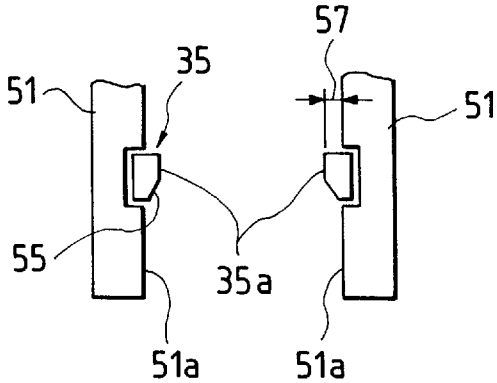

As shown in FIG. 8A, each of the detection electrodes 35 is embedded in the associated limitation wall 51 in such a manner that a contact surface 35*a* of the detection electrode 35 is exposed, and is disposed flush with the inner surface 51*a* of the limitation wall 51. As shown in FIG. 8B, each of the detection electrodes 35 may be such that its contact surface 35*a* projects a distance 57 from the inner surface 51*a* of the associated limitation wall 51 in so far as the detection electrode 35 has a slanting surface 55 substantially continuous with the inner surface 51*a*.

The operation of this fitting detection construction will now be described. The front side of the male housing 25 is registered with a fitting opening 23 in the female housing 21, and the male housing 25 is inserted into the female housing 21, and as a result the short-circuiting electrode 45, mounted on the lock arm 39, is inserted into a space between the pair of limitation walls 51. The short-circuiting electrode 45, thus inserted into the space between the limitation walls 51, is resiliently deformed, and the outwardly-projecting contact portions 47 contact the opposed surfaces 51*a* of the limitation walls 51.

Figure 9:
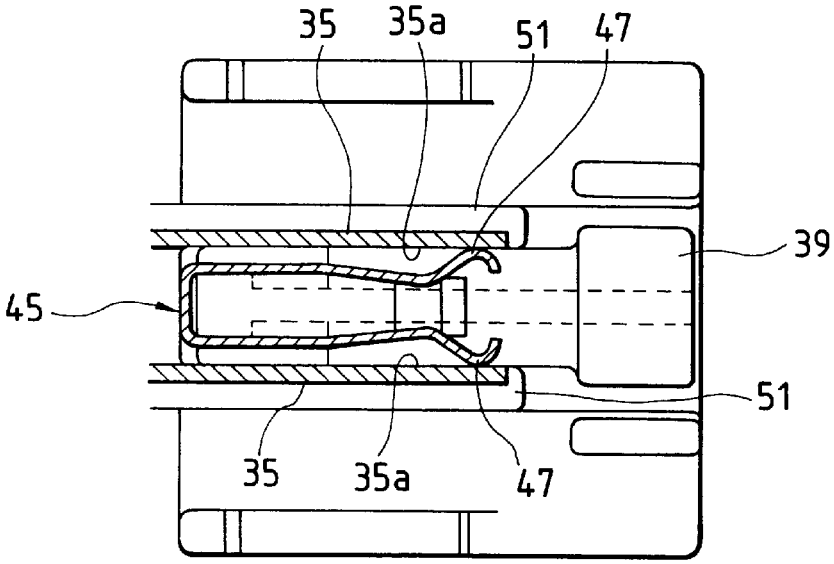
FIG. 9 is a horizontal cross-sectional view of the fitting detection construction of the second embodiment in a fitted condition.

As a result, the distance between the contact portions 47 of the short-circuiting electrode 45 is limited to the distance between the contact surfaces 35*a* of the detection electrodes 35 which are disposed flush with the opposed surfaces 51*a* of the limitation walls 51, respectively, as shown in FIG. 9. The short-circuiting electrode 45 has such a size that even when this electrode 45 is moved downward upon engagement of the lock arm 39 with the press-down portion 27, the short-circuiting electrode 45 is held in contact with the opposed surfaces of the limitation walls 51. Therefore, when the lock projection 41 is disengaged from the press-down portion 27, so that the lock arm 39 moves upward, the contact portions 47 of the short-circuiting electrode 45 move upward in sliding contact with the respective opposed surfaces 51*a* of the limitation walls 51, and reach and contact the respective detection electrodes 35 when the lock arm 39 is completely retained.

In the fitting detection construction of the second embodiment, the pair of limitation walls 51 for limiting the outward displacement of the short-circuiting electrode 45 are provided within the female housing 21, and therefore the contact portions 47 of the short-circuiting electrode 45 can be guided to the detection electrodes 35 spaced a predetermined distance from each other. This is effective for overcoming the following disadvantage.

The short-circuiting electrode 45 moves downward in accordance with the elastic deformation of the lock arm 39, and then moves upward together with the lock arm 39 when the lock arm 39 is restored, so that the short-circuiting electrode 45 slidingly moves to be inserted into the space between the pair of detection electrodes 35 from the lower side of the detection electrodes 35. At this time, if the short-circuiting electrode 45 is outwardly deformed, the deformed leg 45*a* or other portion of the short-circuiting electrode 45 engages the lower surface of the detection electrode 35, thereby preventing the lock arm 39 from being restored upward together with the short-circuiting electrode 45. It is also possible that the detection electrodes 35 are short-circuited together even in this non-retained condition of the lock arm 39. Thus, there is a possibility that even in a condition in which the connectors are not completely fitted together, the pair of detection electrodes 35 are short-circuited together, thereby causing an error in the detection.

On the other hand, in the fitting detection construction of the second embodiment, since the short-circuiting electrode 45 can be kept inwardly of the detection electrodes 35 by the limitation walls 51, the contact portions 47 of the short-circuiting electrode 45 can be positively guided respectively to the contact surfaces 35*a* of the detection electrodes 35. Therefore, the short-circuiting electrode 45 will not be caught by the lower surface of the detection electrode 35, and the interference with restoration of the lock arm 39, an erroneous detection, and damage to the short-circuiting electrode 45 and the detection electrodes 35 are prevented.

Third Embodiment

Next, a third embodiment of a fitting detection construction of the invention will be described with reference to FIGS. 10 to 11C. In this embodiment, a slanting surface (or tapering surface) 61 for guiding a contact portion 47 of a short-circuiting electrode 45 is formed at a lower end of a contact surface 35*a* of each of the pair of detection electrodes 35 for receiving the contact portions 47 therebetween.

Figure 10:
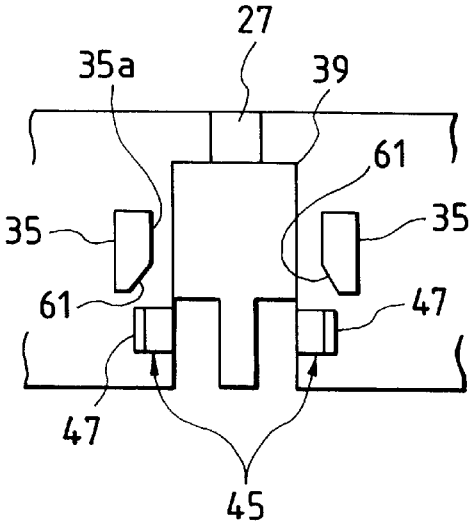
FIG. 10 is a cross-sectional view showing a third embodiment of a fitting detection construction.
Figure 11A:
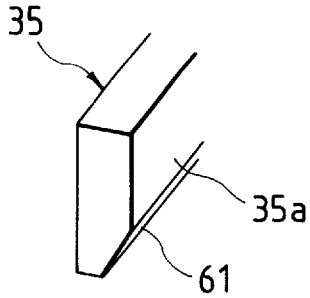
FIGS. 11A, 11B and 11C are perspective views showing the configurations of detection electrodes.
Figure 11B:
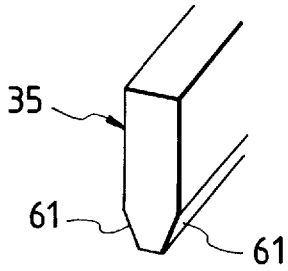
Figure 11C:
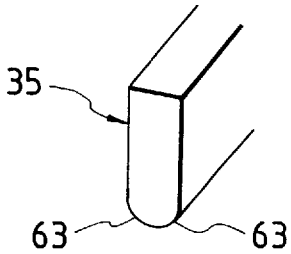

As shown in FIGS. 10 and 11A, the slanting surface 61 is formed by chamfering or removing a corner portion of the detection electrode 35 defined by the contact surface 35 and a lower surface thereof. In another example shown in FIG. 11B, the opposite corner portions at the lower surface of the detection electrode 35 are chamfered to provide slanting surfaces 61 at the opposite sides. By thus forming the slanting surfaces 61 at the opposite sides, the pair of right and left detection electrodes 35 can have a common configuration. In a further example shown in FIG. 11C, instead of the slanting surface 61, a curved surface 63 is formed on the lower surface of the detection electrode 35.

The other portions are similar to those of the fitting detection construction of the first embodiment.

In operation of the fitting detection construction of this embodiment, when the downwardly-moved lock arm 39 moves upward because of its elastic restoring force, the short-circuiting electrode 45, mounted on the lock arm 39, is inserted into the space between the detection electrodes 35 in such a manner that the contact portions 47 of the short-circuiting electrode 45 slide respectively over the slanting surfaces 61 of the detection electrodes 35. Therefore, the interference of the corner portion of each detection electrode 35 with the associated contact portion 47, which would occur without the slanting surface 61, is eliminated.

In the third embodiment, the contact portions 47 of the short-circuiting electrode 45 can be smoothly guided into the space between the detection electrodes 35 by the slanting surfaces 61, and therefore the short-circuiting electrode 45 will not be caught by the lower surface of the detection electrode 35, and the interference with restoration of the lock arm 39, an erroneous detection, and damage to the short-circuiting electrode 45 and the detection electrodes 35 are prevented.

Fourth Embodiment

Next, a fourth embodiment of a fitting detection construction of the invention will be described with reference to FIGS. 12 to 13B.

In this embodiment, tapering projections 71 are formed respectively on contact portions 47 of a pair of legs 45*a* and 45*a* of the short-circuiting electrode 45 to be inserted into a space between a pair of detection electrodes 35, and the tapering projections 71 serve to guide the introduction of the legs 45*a* and 45*a*.

Figure 12:
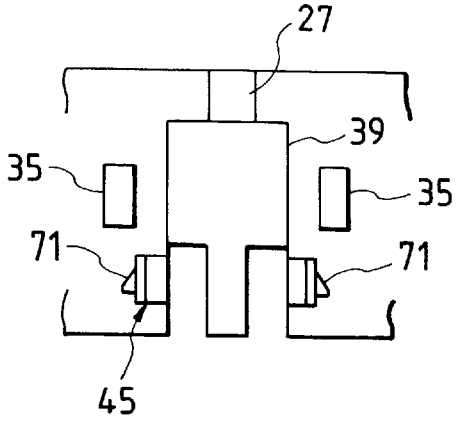
FIG. 12 is a cross-sectional view showing a fourth embodiment of a fitting detection construction.
Figure 13A:
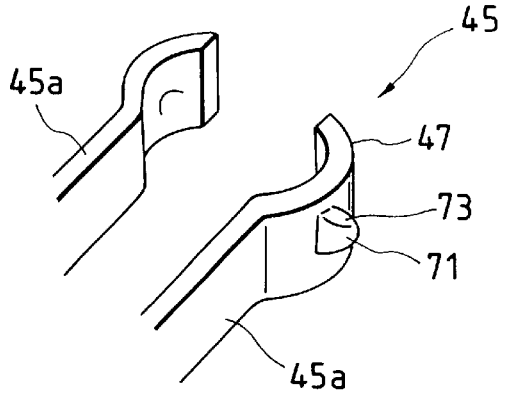
FIGS. 13A and 13B are perspective views showing the configurations of short-circuiting electrodes.
Figure 13B:
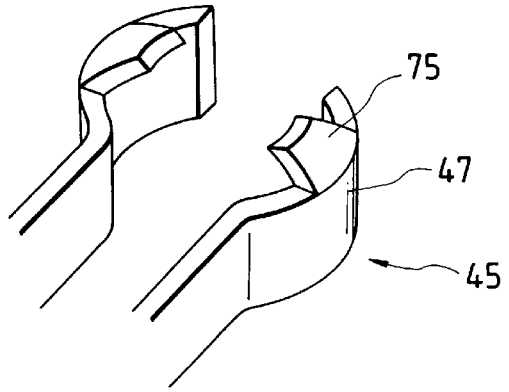
Figure 14:
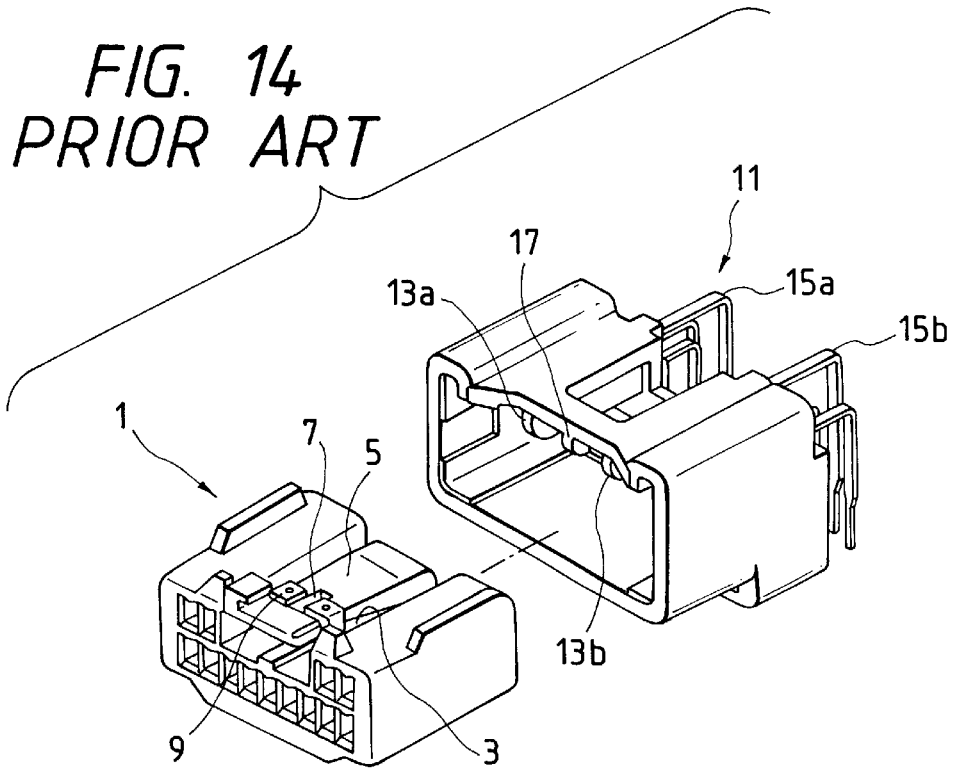
FIG. 14 PRIOR ART
FIG. 14 is a perspective view showing male and female connectors having a conventional fitting detection construction.
Figure 15:
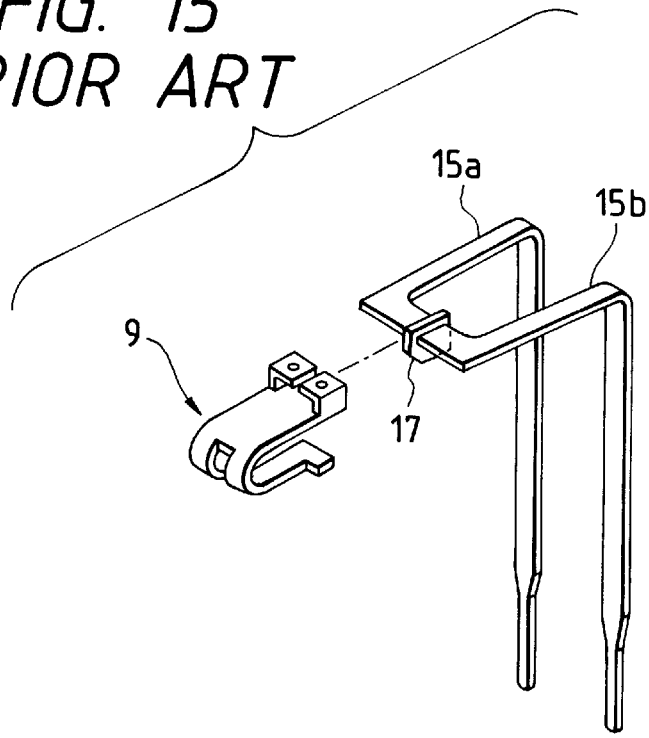
FIG. 15 PRIOR ART
FIG. 15 is a perspective view showing a short-circuiting electrode and detection circuits.
Figure 16:
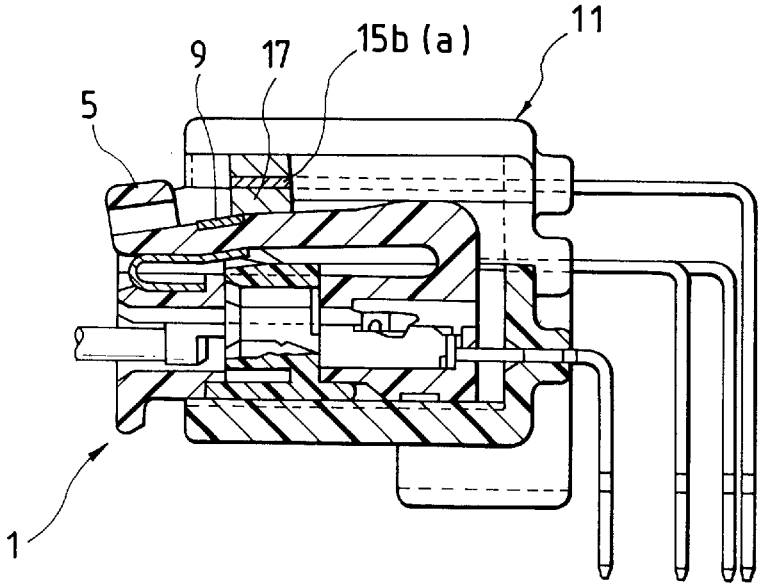
FIG. 16 PRIOR ART
FIG. 16 is a cross-sectional view showing the male and female connectors in the process of fitting the two connectors together.

As shown in FIGS. 12 and 13A, the projection 71 bulges or project from the inner side to the outer side of the contact portion 47, and the projections 71 have respective slanting surfaces 73 which approach each other progressively toward the space between the pair of detection electrodes 35. The projection 71 is formed by indenting the inner surface of the contact portion 47. As shown in FIG. 13B, the projections 71 may be replaced respectively by slanting piece portions 75 which formed respectively on the upper edges of the contact portions 47, and approach each other progressively toward the space between the detection electrodes 35.

The other portions are similar to those of the fitting detection construction of the first embodiment.

In operation of the fitting detection construction of the fourth embodiment, when the downwardly-moved lock arm 39 moves upward because of its elastic restoring force, the projections 71, formed on the short-circuiting electrode 45, engage the lower edges or ends of the detection electrodes 35, respectively, and the slanting surfaces 73 of the projections 71 guide the short-circuiting electrode 45 into the space between the detection electrodes 35. Therefore, when the short-circuiting electrode 45 moves upward in accordance with the restoration of the lock arm 39, the slanting surfaces 73 of the projections 71 are brought into sliding contact with the detection electrodes 35, respectively, so that the short-circuiting electrode 45 can be smoothly introduced into the space between the detection electrodes 35.

In the fourth embodiment, the short-circuiting electrode 45 can be smoothly guided into the space between the detection electrodes 35 by the projections 71, and therefore the short-circuiting electrode 45 will not be caught by the lower surface of the detection electrode 35, and the interference with restoration of the lock arm 39, an erroneous detection, and damage to the short-circuiting electrode 45 and the detection electrodes 35 are prevented.

Although the limitation walls 51, the slanting surfaces 61 and the projections 71 are provided in the second, third and fourth embodiments, respectively, these structures can be suitably used in combination in the fitting detection construction of the invention.

As described above in detail, in the connector fitting detection constructions of the invention, the short-circuiting electrode, having the contact portions, is mounted on the lock arm, and the detection electrodes are provided in a projected manner within the other connector housing, and contact the short-circuiting electrode in the retained condition of the lock arm. Therefore, by the flexing of the lock arm, the contact portions of the short-circuiting electrode move upward and downward in sliding contact with the respective contact surfaces of the detection electrodes. As a result, dirt and dust, deposited on the detection electrodes and the short-circuiting electrode, can be removed, and the incomplete contact in the fitting detection is prevented, thereby enhancing the reliability of the fitting detection function.

In the connector fitting detection construction in which the limitation walls are provided on the other connector housing, and the detection electrodes are embedded respectively in the limitation walls in such a manner that the contact surfaces are exposed, and disposed flush respectively with the opposed surfaces of the limitation walls, the short-circuiting electrode is kept inwardly of the detection electrodes by the limitation walls, and therefore the contact portions of the short-circuiting electrode can be positively guided respectively to the contact surfaces of the detection electrodes.

In the connector fitting detection construction in which the slanting surface for guiding the introduction of the contact portion of the short-circuiting electrode is formed at the end of the contact surface of each of the pair of detection electrodes for receiving the contact portions, the contact portions can be smoothly guided into the space between the detection electrodes by the slanting surfaces.

In the connector fitting detection construction in which the tapering projection for guiding the introduction of the contact portion of the short-circuiting electrode is formed on each of the contact portions to be introduced into the space between the pair of detection electrodes, the contact portions of the short-circuiting electrode can be smoothly guided into the space between the detection electrodes by the tapering projections.

What is claimed is:

1. A connector fitting detection construction for detecting a fitted condition of a first connector that is inserted into a fitting opening of a second connector, the connector fitting detection construction comprising:

a lock arm, which is elastically flexible in a direction generally perpendicular to a connector-fitting direction, provided on said first connector;

a short-circuiting electrode, having retaining projections, mounted on said lock arm; and a pair of spaced apart detection electrodes projecting from a back wall of said second connector toward said fitting opening of said second connector;

wherein, when said lock arm retainingly engages with said second connector, said short-circuiting electrode interposes between and electrically connects said pair of detection electrodes.

2. The connector fitting detection construction of claim 1, further comprising a pair of parallel limitation walls, for receiving said lock arm therebetween, provided on said connector housing of said second connector, wherein each of said detection electrodes is embedded in the associated limitation wall in such a manner that a contact surface of said detection electrode is exposed, and is disposed substantially flush with an inner surface of said limitation wall.

3. The connector fitting detection construction of claim 1, wherein said short-circuiting electrode includes an intermediate section interconnecting two legs to form a generally U-shape, and each of said two legs are disposed respectively on opposite sides of said lock arm.

4. The connector fitting detection construction of claim 3, wherein each of said two legs includes a contact portion for contacting a respective one of said pair of detection electrodes when said short circuit electrode interposes between said pair of detection electrodes.

5. The connector fitting detection construction of claim 4, further comprising a slanting surface, for guiding the introduction of said contact portion of said short-circuiting electrode, formed at an end of a contact surface of each of said detection electrodes for receiving said contact portions.

6. The connector fitting detection construction of claim 4, further comprising a tapering projection, for guiding the introduction of said contact portion of said short-circuiting electrode, formed on each of said contact portions to be introduced into a space between said detection electrodes.

7. The connector fitting detection construction of claim 4, wherein said contact portions are arranged in a direction perpendicular to a flexing direction of said lock arm.

* * * * *